US009114946B2

(12) United States Patent
Misawa

(10) Patent No.: US 9,114,946 B2
(45) Date of Patent: Aug. 25, 2015

(54) RECORDING APPARATUS

(71) Applicant: SEIKO EPSON CORPORATION, Tokyo (JP)

(72) Inventor: Yuji Misawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/325,704

(22) Filed: Jul. 8, 2014

(65) Prior Publication Data

US 2015/0014917 A1 Jan. 15, 2015

(30) Foreign Application Priority Data

Jul. 10, 2013 (JP) ..... 2013-144266

(51) Int. Cl.

| | |
|---|---|
| ***B65H 5/26*** | (2006.01) |
| ***B65H 5/36*** | (2006.01) |
| ***B65H 5/06*** | (2006.01) |
| ***B65H 9/00*** | (2006.01) |

(52) U.S. Cl.

CPC .. *B65H 5/26* (2013.01); *B65H 5/06* (2013.01); *B65H 5/36* (2013.01); *B65H 9/002* (2013.01); *B65H 2404/7414* (2013.01); *B65H 2407/21* (2013.01)

(58) Field of Classification Search

CPC .. B65H 2407/20; B65H 2407/21; B65H 5/26; B65H 5/36; B65H 9/002; B65H 2404/7414; B65H 2404/20; B65H 2404/21

USPC ..... 271/9.09, 225, 65, 264, 209; 399/392

See application file for complete search history.

(56) References Cited

U.S. PATENT DOCUMENTS

| | | | | |
|---|---|---|---|---|
| 6,332,068 | B2 * | 12/2001 | Blackman et al. | 399/364 |
| 7,021,757 | B2 * | 4/2006 | Kida | 347/104 |
| 7,055,949 | B2 * | 6/2006 | Ohashi | 347/104 |
| 7,063,473 | B2 * | 6/2006 | Ohashi et al. | 400/642 |
| 7,114,867 | B2 * | 10/2006 | Ohashi et al. | 400/642 |
| 7,222,955 | B2 * | 5/2007 | Ohashi et al. | 347/104 |
| 8,152,169 | B2 * | 4/2012 | Samoto et al. | 271/301 |
| 8,493,639 | B2 * | 7/2013 | Samoto et al. | 358/498 |
| 8,508,819 | B2 * | 8/2013 | Asada et al. | 358/498 |
| 2001/0000462 | A1 * | 4/2001 | Blackman et al. | 399/13 |
| 2009/0121416 | A1 * | 5/2009 | Tashiro et al. | 271/225 |
| 2009/0134571 | A1 * | 5/2009 | Kotaka | 271/264 |
| 2013/0134661 | A1 * | 5/2013 | Yoshinaga | 271/225 |
| 2014/0035219 | A1 * | 2/2014 | Yamamoto | 271/9.09 |

FOREIGN PATENT DOCUMENTS

| | | |
|---|---|---|
| JP | 2010-116228 | 5/2010 |

* cited by examiner

*Primary Examiner* — Patrick Cicchino
(74) *Attorney, Agent, or Firm* — Workman Nydegger

(57) ABSTRACT

Provided is a recording apparatus which includes a recording portion which performs recording on a medium, a transport path which extends to the recording portion, a feeding mechanism which sends the medium to the transport path, a manual feeding path which meets the transport path in such a manner that an extending direction of the manual feeding path changes to intersect the transport path and, a guide portion which is disposed in a meeting portion between the transport path and the manual feeding path. When the medium is sent back by the feeding mechanism, the guide portion does not move and, when the medium is inserted into the manual feeding path, the guide portion moves in a direction in which the guide portion is broadened.

4 Claims, 9 Drawing Sheets

RECORDING APPARATUS

BACKGROUND

1. Technical Field

The present invention relates to a recording apparatus, such as an ink jet type printer.

2. Related Art

A certain type of an ink jet type printer as an example of a recording apparatus includes a manual feeding side transport path through which a paper sheet mounted on a manual feeding tray is transported, in addition to a cassette side transport path through which a paper sheet received in a paper feeding cassette is automatically transported (for example, see JP-A-2010-116228).

Meanwhile, in a meeting portion where the two transport paths described above meet, at least one transport path changes in width in a height direction, that is, an extending direction changes. Thus, a paper sheet which passes through the meeting portion through the transport path of which the extending direction changes is bent along the shape of the transport path and a movement direction of the paper sheet changes.

Accordingly, in a case of the transport path of which the extending direction changes in the meeting portion, it is necessary to send a paper sheet with a stronger force, compared to a case where a paper sheet is sent through the transport path of which the extending direction is fixed in the meeting portion, that is, the extending direction does not change and the transport path extends linearly. From this point, in a case where a paper sheet is fed, using a feeding mechanism, from the paper feeding cassette, it is possible to increase a paper sending force by regulating, for example, a driving force of the feeding mechanism.

On the contrary, in a case where the manual feeding path to which a paper sheet is inserted in a manual feeding manner meets the cassette side transport path of which the extending direction does not change in the meeting portion and which extends linearly, such that the cassette side transport path intersects with the manual feeding path at a predetermined angle, when a leading edge side of the paper sheet inserted into the manual feeding path reaches the meeting portion, the paper sheet is bent. As a result, an insertion resistance of the paper sheet increases. When the insertion resistance of the paper sheet increases, a user misunderstands that the insertion of the paper sheet to a desired position is completed and stops further insertion. Thus, there is a problem in that the paper sheet is not inserted to a position where the paper sheet can be automatically transported.

It is also possible to conceive, as a method for solving the problem described above, that the manual feeding path extend linearly without change in the extending direction in the meeting portion and the cassette side transport path and the manual feeding path meet so as to intersect with each other at a predetermined angle. However, when the shape of the cassette side transport path is changed as described above, it is necessary to change an arrangement of the feeding mechanism and the like. As a result, it is necessary to significantly change the design. Therefore, it is preferable that a paper-sheet insertion resistance relative to the manual feeding path be reduced in such a manner that paths relative to manual paper feeding and paper feeding from the cassette side are formed to have a simple configuration.

The problems described above are not limited to an ink jet type printer which performs printing on a paper sheet but is generally common to recording apparatuses having a manual feeding path of which an extending direction changes in the meeting portion between the manual feeding path and another transport path.

SUMMARY

An advantage of some aspects of the invention is to provide a recording apparatus which can reduce a medium insertion resistance relative to a manual feeding path of which an extending direction changes in a meeting portion between the manual feeding path and a transport path, without significantly changing the shape of a transport path through which a medium is automatically transported to a recording portion.

Hereinafter, means of the invention and operational effects thereof will be described.

According to an aspect of the invention, there is provided a recording apparatus that includes a recording portion which performs recording on a medium, a transport path which extends to the recording portion, a feeding mechanism which sends the medium to the transport path, a manual feeding path into which the medium is fed from an opening portion for manual feeding and the medium is fed, and a guide portion which is disposed in a meeting portion between the transport path and the manual feeding path and guides transport of the medium, in which, when the medium is sent back by the feeding mechanism, the guide portion does not move and, when the medium is inserted into the manual feeding path, the guide portion moves in a direction in which the guide portion is broadened.

According to the configuration described above, the guide portion disposed in the meeting portion moves, and thus the insertion resistance of the medium is reduced, relative to the manual feeding path. Therefore, the insertion resistance of the medium can be reduced, relative to the manual feeding path of which an extending direction changes in the meeting portion between the manual feeding path and the transport path, without significantly changing the shape of the transport path through which the medium is automatically transported to the recording portion.

In addition, according to the configuration described above, when the medium is inserted into the manual feeding path, the guide portion moves in a direction in which the area of the meeting portion is expanded. Thus, the insertion resistance of the medium can be reduced, relative to the manual feeding path.

In the recording apparatus described above, it is preferable that the guide portion be provided on one end side of a movable member which is pressed by the medium inserted into the manual feeding path and pivots and the guide portion move to an external side of the manual feeding path in accordance with pivoting of the movable member.

According to the configuration described above, when the medium is inserted into the manual feeding path, the movable member pivots. Thus, the guide portion provided on one end side of the movable member can be moved, in accordance with the pivoting operation, from the inner side of the meeting portion to the external side of the manual feeding path. Therefore, the area of the meeting portion is expanded, and thus the insertion resistance of the medium can be reduced, relative to the manual feeding path. Furthermore, the movable member is pressed by the medium inserted into the manual feeding path, and thus the movable member pivots. Accordingly, without providing a sensor for sensing the insertion of the medium into the manual feeding path or a driving source for pivoting the movable member, it is possible to move the guide portion with a simple configuration.

The recording apparatus described above may further include a driving roller which sends back the medium which is sent by the feeding mechanism and passes through the meeting portion, to the feeding mechanism side, and a restriction member which restricts movement of the guide portion. It is preferable that deflection displacement of the medium which is sent back by the driving roller be regulated by the guide portion of which the movement is restricted by the restriction member, and thus skew of the medium be corrected.

According to the configuration described above, when the driving roller causes the medium to be sent back to the feeding mechanism side, the medium is deflectively displaced in the meeting portion and comes into contact with the guide portion. In this case, the movement of the guide portion is restricted by the restriction member, and thus, even when the deflectively displaced medium presses the guide portion, the guide portion does not move. Therefore, the deflection displacement of the medium is regulated, and thus the skew of the medium in the transport path is corrected. On the contrary, in a case where the guide portion is not disposed in the meeting portion, the deflection displacement of the medium which is sent back by the feeding mechanism is large. As a result, there is possibility that a skew correction function may be deteriorated. In other words, the restriction member restricts the movement of the guide portion, and thus it is possible to prevent the feeding mechanism from reducing a feeding precision of the medium.

In the recording apparatus, it is preferable that, when the medium is inserted into the manual feeding path, the restriction member release movement restriction of the guide portion.

According to the configuration described above, when the medium is inserted into the manual feeding path, the restriction member releases the movement restriction of the guide portion. Thus, when the medium is inserted into the manual feeding path, it is possible to reduce the insertion resistance of the medium, in such a manner that the guide portion is moved.

In the recording apparatus, it is preferable that the restriction member have an engaging protrusion portion which can protrude to the manual feeding path and, when the medium inserted into the manual feeding path abuts on the engaging protrusion portion, the restriction member release the movement restriction of the guide portion.

According to the configuration described above, when the medium inserted into the manual feeding path abuts on the engaging protrusion portion, the movement restriction of the guide portion is released. Thus, without providing, for example, a sensor for sensing the insertion of the medium into the manual feeding path, it is possible to distinguish an insertion path of the medium with a simple configuration and it is possible to control a movement of the guide portion.

In the recording apparatus, it is preferable that the manual feeding path be constituted by a first path forming portion which is disposed further to an upstream side in a medium insertion direction than the meeting portion and a second path forming portion which is disposed in the meeting portion. It is preferable that an extending direction of the first path forming portion intersect with the transport path at an angle θ1 and an extending direction of the second path forming portion intersect with the transport path at an angle θ2 smaller than the angle θ1. It is preferable that, when the guide portion is disposed in the meeting portion, the guide portion protrude further on an inner side of the meeting portion than the second path forming portion and, when the medium is inserted into the manual feeding path, the guide portion move further on an external side of the meeting portion than the second path forming portion.

According to the configuration described above, when the medium is sent by the feeding mechanism, the medium sent by the feeding mechanism can be guided by the guide portion which protrudes further on the inner side of the meeting portion than the second path forming portion. Meanwhile, when the medium is inserted into the manual feeding path, the guide portion moves further on the external side of the meeting portion than the second path forming portion. Therefore, the medium which is guided, by the first path forming portion, to the meeting portion is guided by the second path forming portion and passes through the meeting portion. In this case, the intersection angle between the second path forming portion and the transport path is smaller than the intersection angle between the first path forming portion and the transport path, and thus a change in the movement direction of the medium is gentle in the meeting portion. Thus, it is possible to prevent the medium from being caught by the second path forming portion. In other words, since the intersection angle between the manual feeding path and the transport path is reduced by moving the guide portion outside the meeting portion, the insertion resistance of the medium can be reduced, relative to the manual feeding path.

In the recording apparatus, it is preferable that the guide portion be a rotary roller which can rotate in one direction. It is preferable that the rotary roller rotate in the one direction, in accordance with movement of the medium which passes through the manual feeding path and enters the meeting portion.

According to the configuration described above, when the medium inserted into the manual feeding path by manual feeding enters the meeting portion, the rotary roller rotates in accordance with the movement of the medium, of which the movement direction changes in the meeting portion. Thus, it is possible to reduce the insertion resistance of the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a recording apparatus will be described with reference to the accompanying drawings. The recording apparatus is, for example, a printer which performs recording (printing) in such a manner that ink as an example of liquid is ejected onto a medium.

Embodiment 1

Figure 1:
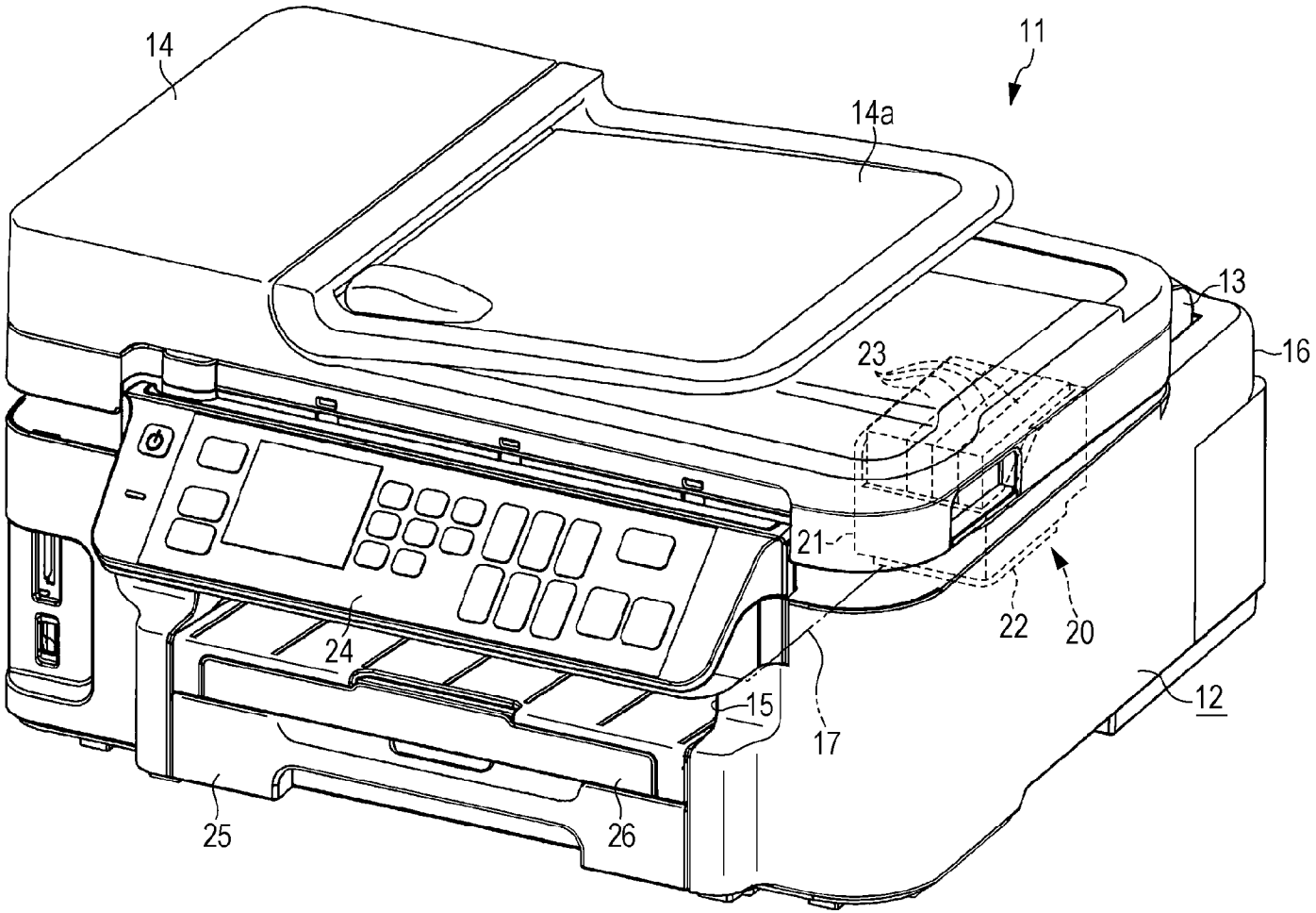
FIG. 1 is a perspective view of a multifunction printer having a recording apparatus of Embodiment 1.

A multifunction printer 11 includes a recording apparatus 12 of Embodiment 1, and an image reading device 14 which is openably/closably mounted on the recording apparatus 12 via a hinge portion 13, as illustrated in FIG. 1. The image reading device 14 performs image reading of an image recorded on one or more paper sheets which are disposed on the paper-sheet mounting portion 14*a*.

The recording apparatus 12 includes a casing portion 16 in which an opening portion 15 is formed and a recording portion 20 which is disposed inside the casing portion 16 and performs recording on a medium 17. Furthermore, in Embodiment 1, in some cases, a side on which the opening portion 15 is formed in the casing portion 16 is set to a front side and a side on which the hinge portion 13 is provided is set to a rear side.

The recording portion 20 includes a carriage 21 which is reciprocatable in a longitudinal direction of the casing portion 16, and a recording head 22 which is disposed on a bottom surface side of the carriage 21. A receiving portion 23 in which ink which is a recording material and supplied to the recording head 22 is received is attachably/detachably mounted on the carriage 21.

In the casing portion 16, an operation panel 24 for operating the multifunction printer 11 is installed on an upper side of the opening portion 15, in a state where the operation panel 24 protrudes forward. A feeding cassette 25 in which a plurality of the media 17 can be received in a stacked state is attachably/detachably mounted on a bottom surface side of the casing portion 16. In the casing portion 16, a discharge tray 26 which is extendable/contractible and in which the medium 17 discharged through the opening portion 15 is received is disposed in a portion between the opening portion 15 and the feeding cassette 25.

Figure 2:
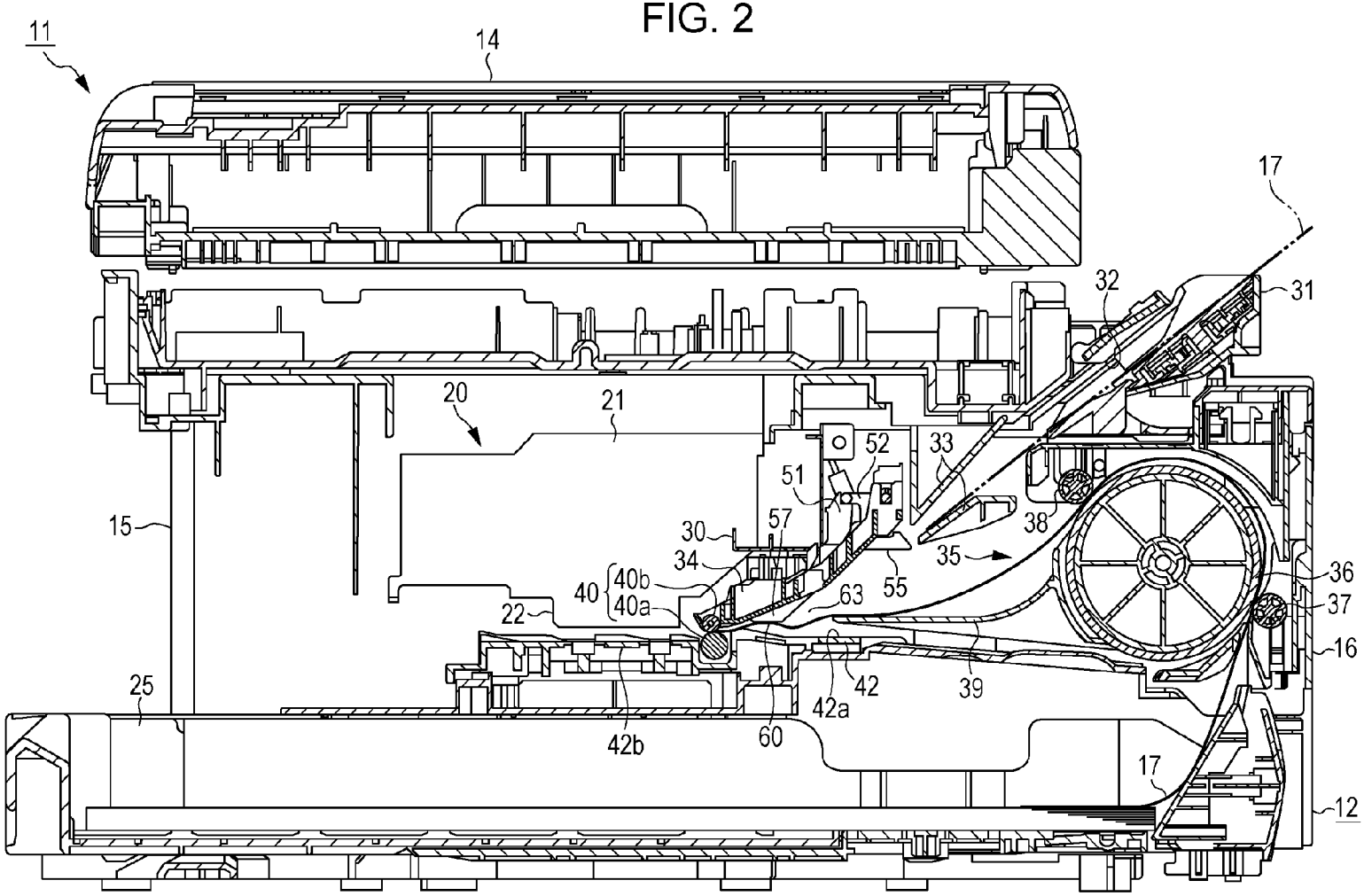
FIG. 2 is a cross-sectional view of the multifunction printer.

In the casing portion 16, a manual feed guide 31 is pivotally installed on the rear side (a right side in FIG. 2) of the image reading device 14, as illustrated in FIG. 2. In the casing portion 16, an insertion opening 32 through which the medium 17 is inserted in the casing portion 16 is formed in a portion in which the manual feed guide 31 is mounted.

An insertion path forming member 33 which guides the medium 17 inserted through the insertion opening 32 is disposed in the casing portion 16, in a state where the insertion path forming member 33 is inclined downward toward the front side. In addition, a manual feed path forming member 34 which is supported by a support frame 30 is disposed in a portion between the insertion path forming member 33 and the recording portion 20. The insertion path forming member 33 and the manual feed path forming member 34 form a manual feed path which extends from the insertion opening 32 to the recording portion 20.

In a rear portion of the casing portion 16, a feeding mechanism 35 which sends the medium 17 received in the feeding cassette 25, to a transport path extending toward the recording portion 20, is disposed in a portion between the manual feed guide 31 and the feeding cassette 25. The feeding mechanism 35 includes an intermediate roller 36 which is rotated by a driving force from a driving source (not illustrated), a retard roller 37, and an assist roller 38. The medium 17 is pinched between the retard roller 37 and the intermediate roller 36 and between the assist roller 38 and the intermediate roller 36. The retard roller 37 and the assist roller 38 rotate to follow the rotation of the intermediate roller 36.

In a position below the insertion path forming member 33, the transport path forming member 39 extending toward the front side is disposed on a front side of the intermediate roller 36. The transport path forming member 39 forms a transport path which linearly extends from the feeding mechanism 35 to the recording portion 20. The manual feeding path meets the transport path, in a state where an extending direction of the manual feed path changes so as to intersect with the transport path at an acute angle.

A driving roller 40*a* and a driven roller 40*b* which constitute a transport roller pair 40 are disposed just behind the recording head 22. The driving roller 40*a* is supported in a support member 42 disposed in a position in which the support member 42 faces the manual feed path forming member 34 and the recording portion 20. The driven roller 40*b* is supported in a tip side (a left end side in FIG. 2) of the manual feed path forming member 34, in a state where the driven roller 40*b* is rotatable. The driving roller 40*a* is rotated by the driving force from a driving source (not illustrated) and the driven roller 40*b* rotates to follow the rotation of the driving roller 40*a*.

In the support member 42, a transport path forming surface 42*a* forming the transport path is provided in a position facing the manual feed path forming member 34. Furthermore, in the support member 42, a medium support portion 42*b* for supporting the medium 17 is provided in a position facing the recording portion 20.

Figure 3:
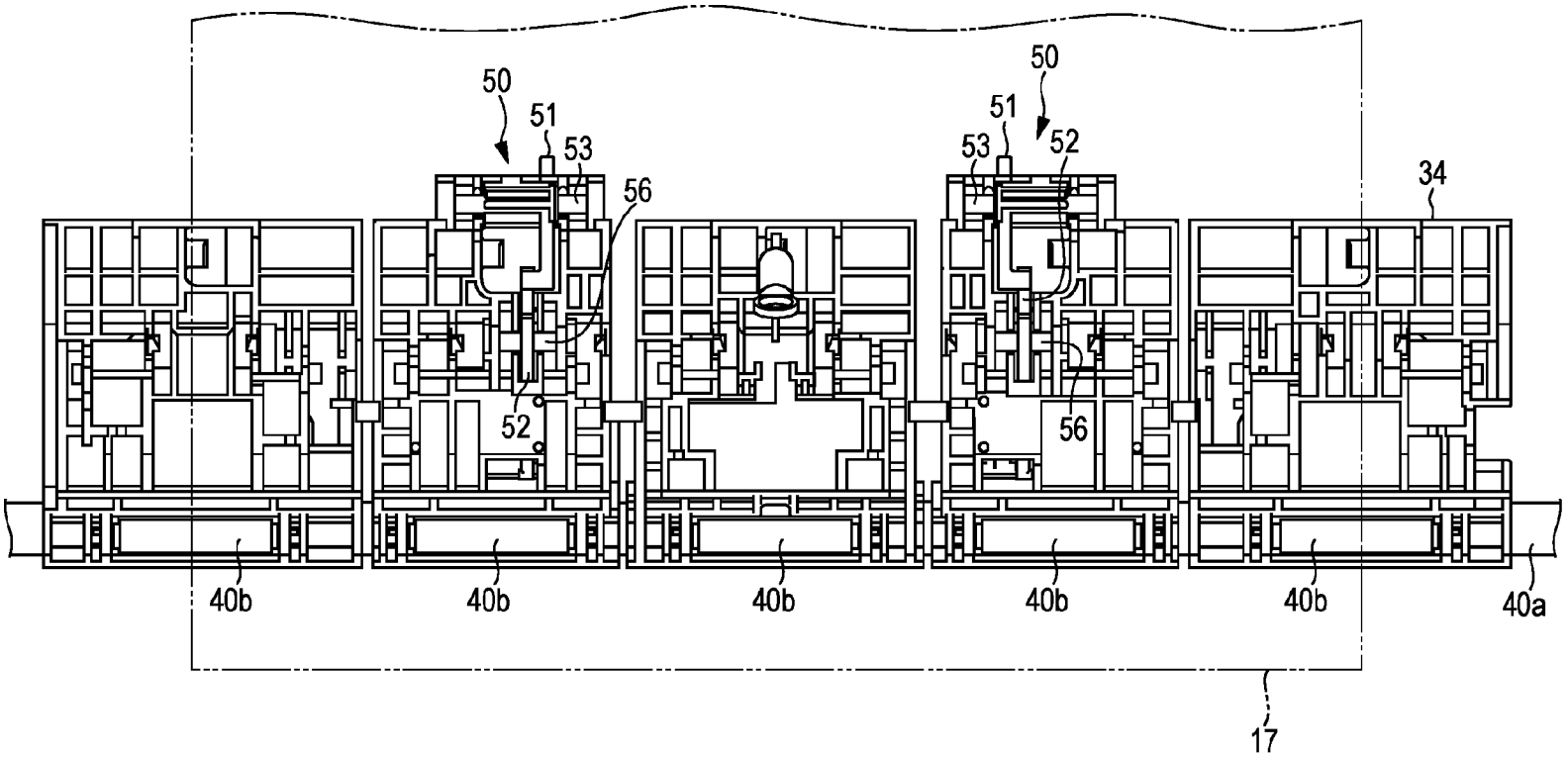
FIG. 3 is a top view of a movable mechanism of Embodiment 1.

The manual feed path forming member 34 supports a pair of movable mechanisms 50 which are arranged to be aligned in a width direction (a right-left direction in FIG. 3) of the medium 17, as illustrated in FIG. 3. The movable mechanism 50 includes a movable member 51 which is rotatably supported in a base end side (a rear end side) of the manual feed path forming member 34 and a restriction member 52 which is rotatably supported in the vicinity of a central portion of the manual feed path forming member 34 in a front-rear direction.

Figure 4:
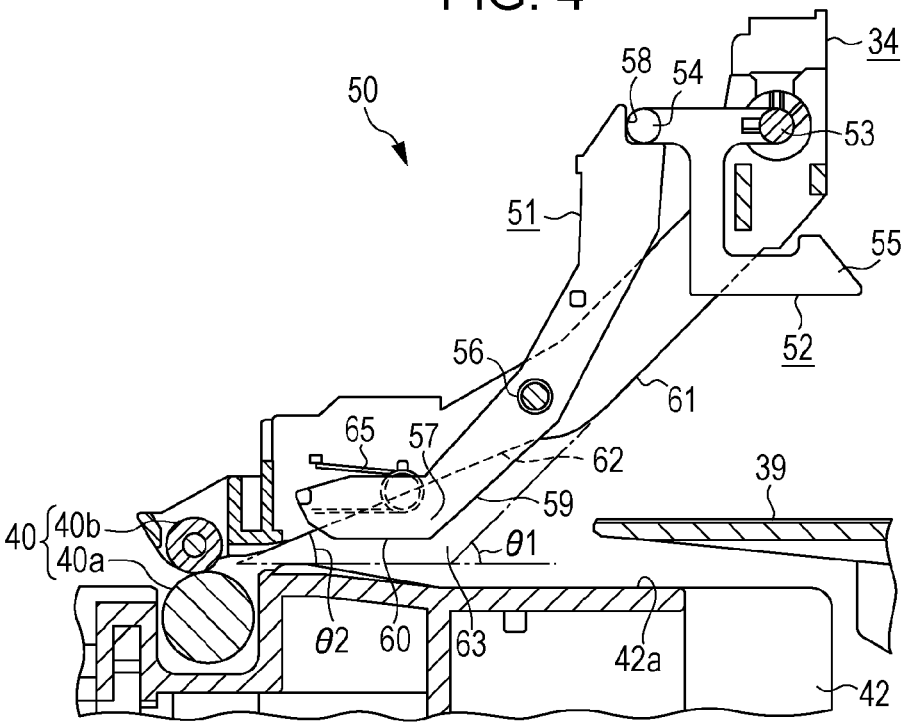
FIG. 4 is a cross-sectional view illustrating a configuration of the movable mechanism of Embodiment 1.

The manual feed path forming member 34 has a first path forming portion 61 which is disposed in a position facing the transport path forming member 39 and a second path forming portion 62 which is disposed in a position facing the transport path forming surface 42*a*, as illustrated in FIG. 4.

A part of the transport path forming member 39, which is formed on a front side, is a meeting portion 63 in which the manual feeding path meets the transport path. The first path forming portion 61 is disposed further to an upstream side in an inserting direction of the medium 17 than the meeting portion 63. The second path forming portion 62 is disposed in the meeting portion 63. An extending direction of the first path forming portion 61 intersects with the transport path at an angle θ1 and an extending direction of the second path forming portion 62 intersects with the transport path at an angle θ2 smaller than the angle θ1.

The restriction member 52 has a pivot shaft portion 53 which is pivotally supported in a base end side (a right end side in FIG. 4) of the manual feed path forming member 34, a restriction portion 54 which extends from the pivot shaft portion 53 to the front side (a left side in FIG. 4) and is engaged with the movable member 51, and an engaging protrusion portion 55 which can protrude to the manual feeding path.

The movable member 51 has a pivot shaft portion 56 which is pivotally supported to the manual feed path forming member 34, a movable portion 57 which functions as a guide portion and is disposed further to a tip side (a left end side in FIG. 4) than the pivot shaft portion 56, and an engaging wall portion 58 which is disposed further to a base end side (a right end side in FIG. 4) than the pivot shaft portion 56. When the restriction portion 54 of the restriction member 52 is disposed behind the engaging wall portion 58 of the movable member 51, as illustrated in FIG. 4, the restriction portion 54 of the restriction member 52 restricts pivoting of the movable member 51 in a clockwise direction in FIG. 4.

The movable portion 57 has a first pressure receiving portion 59 and a second pressure receiving portion 60. When the movable portion 57 is disposed in the meeting portion 63, an extending direction of the movable portion 57 is substantially parallel to the extending direction of the first path forming portion 61. When the second pressure receiving portion 60 is disposed in the meeting portion 63, an extending direction of the second pressure receiving portion 60 is substantially parallel to the transport path.

Figure 5:
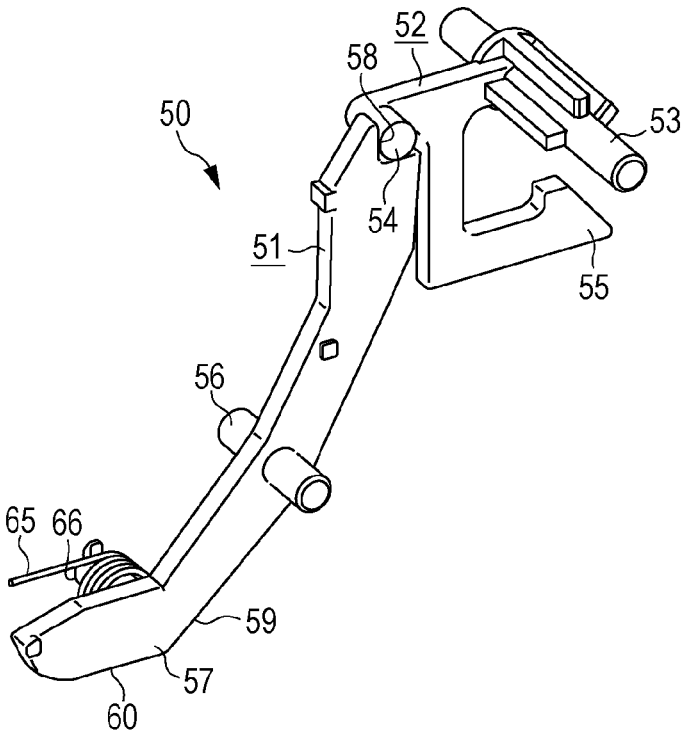
FIG. 5 is a perspective view of the movable member and a restriction member of Embodiment 1.

In a tip side of the movable member 51, a protrusion portion 66 to which a biasing member 65 is attached protrudes in the width direction, as illustrated in FIG. 5. The movable member 51 is biased, by the biasing member 65, in a counter-clockwise direction in FIG. 4.

Next, an operation of the recording apparatus 12 configured as described above will be described.

Before feeding of the medium 17 by the feeding mechanism 35 or insertion of the medium 17 into the manual feeding path is performed, the restriction member 52 and the movable member 51 are disposed in a non-operating position illustrated in FIGS. 2 and 4. In this case, the movable member 51 is in a state where pivoting (pivoting in a counter-clockwise direction in FIGS. 2 and 4) of the movable member 51 by a biasing force of the biasing member 65 is restricted by the support frame 30 (see FIG. 2).

When the movable member 51 is positioned in the non-operating position, the movable portion 57 is disposed in the meeting portion 63. Thus, the movable portion 57 is in a state where the first pressure receiving portion 59 and the second pressure receiving portion 60 protrude further on an inner side of the meeting portion 63 than the second path forming portion 62. In this case, the second pressure receiving portion 60 forms, along with the transport path forming surface 42*a*, the transport path. The first pressure receiving portion 59 forms, along with the first path forming portion 61, the manual feeding path which intersects with the transport path at the angle θ1.

When recording is performed on the medium 17 received in the feeding cassette 25, the medium 17 is sent to the transport path by the feeding mechanism 35.

The medium 17 sent from the feeding cassette 25 enters the meeting portion 63 in accordance with the rotation of the intermediate roller 36 in the counter-clockwise direction in FIG. 2, as shown by the medium 17 illustrated by a solid line in FIG. 2. In this case, the transport path forming member 39 is positioned above the transport path forming surface 42*a*, and thus the medium 17 guided to the transport path forming member 39 falls, from the transport path forming member 39, on the transport path forming surface 42*a* and enters the meeting portion 63.

When a leading edge of the medium 17 which moves forward along the transport path forming surface 42*a* passes through the meeting portion 63, rotation of the intermediate roller 36 is temporally stopped and the driving roller 40*a* rotates in a reverse rotation direction, that is, a clockwise direction in FIG. 2, at a predetermined rotation angle. Accordingly, the medium 17 is sent back to the feeding mechanism 35 side.

The leading edge side of the medium 17 is sent back, and thus the medium 17 is deflectively displaced so as to bulge upward. Therefore, the medium 17 comes into contact with the second pressure receiving portion 60 of the movable portion 57, as illustrated in FIG. 2. Then, the medium 17 which tends to be deflectively displaced even more presses the second pressure receiving portion 60 of the movable portion 57. However, pivoting of the movable member 51 is restricted by the restriction member 52, and thus movement of the movable portion 57 is restricted.

Therefore, further deflection displacement of the medium 17 is prevented, and thus the medium 17 is pressed back. Therefore, the leading edge side is pressed by the transport roller pair 40. As a result, when a leading edge of the medium 17 is skewed with respect to the width direction, the direction of the medium 17 is corrected such that the leading edge thereof is set to be parallel to the width direction. In other words, deflection displacement of the medium 17 which is sent back by the driving roller 40*a* is regulated by the movable portion 57, and thus the skew of the medium 17 is corrected.

When the skew of the medium 17 is corrected, and then the driving roller 40*a* and the intermediate roller 36 rotate in a normal rotation direction, that is, the counter-clockwise direction in FIG. 2, the medium 17 is pinched between the transport roller pair 40 and transported to the recording portion 20. Subsequently, the ink is ejected, through the recording head 22, onto the medium 17 which is transported to an upper portion of the medium support portion 42*b* by the transport roller pair 40, and thus recording (printing) is performed.

Meanwhile, in a case where recording is performed on the medium 17 which is inserted, through the manual feed guide 31, into the casing portion 16 in a manual feeding manner, the medium 17 is inserted into the manual feeding path by manual feeding.

The medium 17 inserted into the manual feeding path is guided by the insertion path forming member 33 and moves to the meeting portion 63, as shown by the medium 17 illustrated by a two-dot chain line in FIG. 2.

Figure 6:
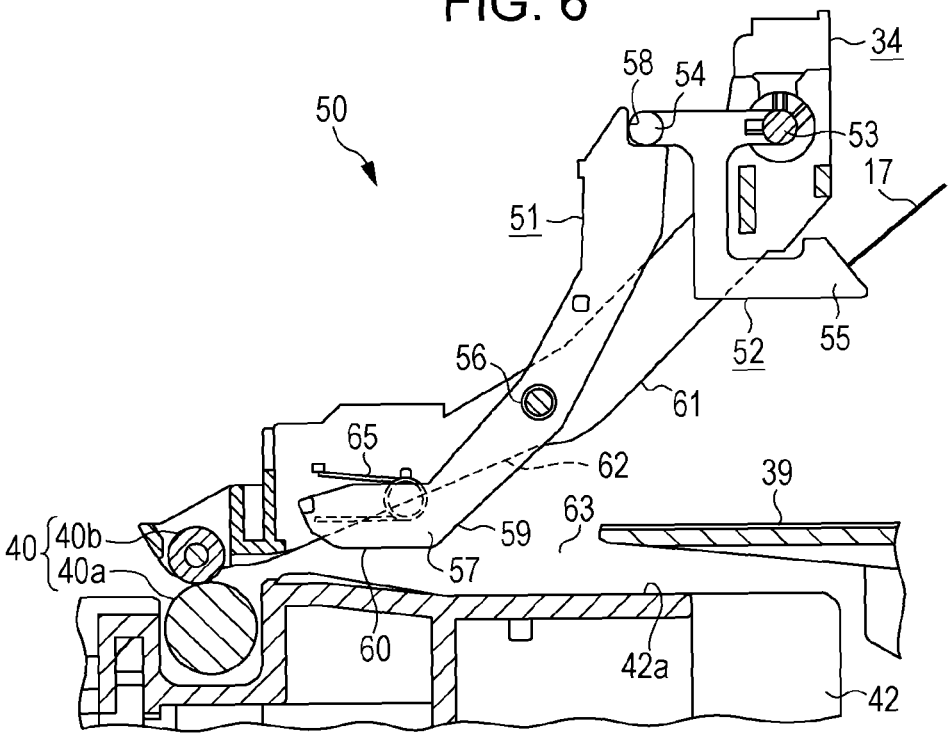
FIG. 6 is a cross-sectional view illustrating an operation of the restriction member of Embodiment 1.

Then, when the leading edge of the medium 17 abuts on the engaging protrusion portion 55 of the restriction member 52, the restriction member 52 is pressed by the medium 17, and thus pivots in the clockwise direction in FIG. 6, as illustrated in FIG. 6. Accordingly, the restriction member 52 is disposed in a position illustrated in FIG. 7.

Figure 7:
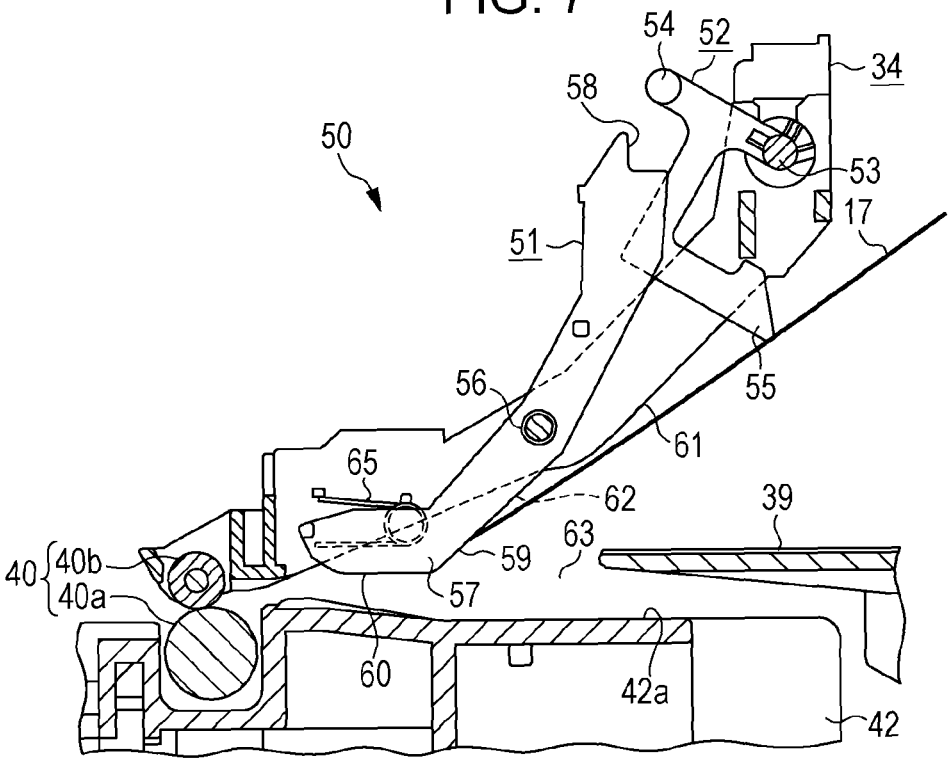
FIG. 7 is a cross-sectional view illustrating an operation of the movable member of Embodiment 1.

When the restriction member 52 pivots, and thus the restriction portion 54 moved upward, as illustrated in FIG. 7, restriction of pivoting of the movable member 51 by the restriction member 52 is released. In other words, in a case where the medium 17 is inserted into the manual feeding path and abuts on the engaging protrusion portion 55, the restriction member 52 releases movement restriction of the movable portion 57.

When the leading of the medium 17 which is guided by the first path forming portion 61 and moves to the manual feeding path enters the meeting portion 63 and presses the first pressure receiving portion 59 of the movable portion 57, the movable member 51 pivots in the clockwise direction in FIG. 7, against the biasing force of the biasing member 65.

Figure 8:
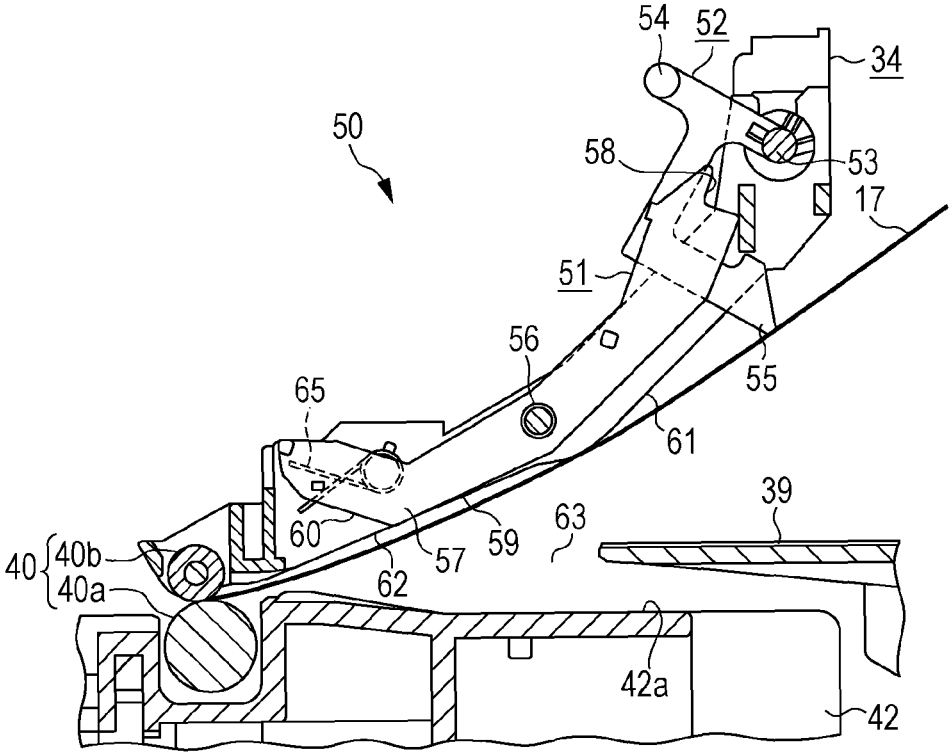
FIG. 8 is a cross-sectional view illustrating an operation of the movable mechanism of Embodiment 1.

Accordingly, the movable portion 57 provided on one end side of the movable member 51 moves, in accordance with pivoting of the movable member 51, further on an external side of the meeting portion 63 than the second path forming portion 62, as illustrated in FIG. 8. As a result, the area of the meeting portion 63 is expanded by as much as a part of the movable portion 57, which protrudes to the meeting portion 63. In other words, when the medium 17 is inserted into the manual feeding path, the movable portion 57 moves in a direction in which the area of the meeting portion 63 is expanded, that is, outside the manual feeding path.

The movable portion 57 moves outside the meeting portion 63, and thus the second path forming portion 62 forms the manual feeding path in the meeting portion 63. Therefore, an intersection angle between the manual feeding path and the transport path is changed from the angle θ1 to the angle θ2 smaller than the angle θ1.

Accordingly, although the medium 17 bumps into the transport path forming surface 42*a* in the meeting portion 63, and thus the medium 17 is deflectively displaced and changes movement direction, the extent of the change is gentle, compared to a case where the movable portion 57 protrudes to the meeting portion 63. Thus, upon comparison with a case where the movable portion 57 protrudes to the meeting portion 63, when the movable portion 57 moves outside the meeting portion 63, an insertion resistance of the medium 17 is reduced, relative to the manual feeding path. In other words, when the medium 17 is sent by the feeding mechanism 35, the movable portion 57 does not move and when the medium 17 is inserted into the manual feeding path, the movable portion 57 moves in a direction in which the insertion resistance of the medium 17 is reduced, relative to the manual feeding path.

When the leading edge of the medium 17 of which the movement direction is changed in the meeting portion 63 passes through the meeting portion 63 and is pinched by the transport roller pair 40, the medium 17 can be automatically transported by the transport roller pair 40. Thus, an insertion operation of the medium 17 by manual feeding is completed. In this state, when the driving roller 40*a* rotates in the normal rotation direction, that is, the counter-clockwise direction in FIG. 8, the medium 17 is transported to the recording portion 20. Subsequently, the ink is ejected, through the recording head 22, onto the medium 17 transported by the transport roller pair 40, and thus recording (printing) is performed.

In a case where the medium 17 is inserted into the manual feeding path, when the movable portion 57 does not move and is disposed in the meeting portion 63, the medium 17 comes into contact with the movable portion 57 which is located inside the medium 17 in a curved state, to the extent that the medium 17 is deflectively displaced along the transport path forming surface 42*a* and changed in movement direction. As a result, the insertion resistance of the medium 17 increases.

Therefore, a user who inserts the medium 17 misunderstands that the insertion of the medium 17 to a desired position is completed, and thus there is a concern that the user may stop further insertion of the medium 17. In this case, the insertion of the medium 17 is stopped in a state where the leading edge of the medium 17 is not pinched by the transport roller pair 40. Therefore, there is a possibility that a transport error, for example, not being able to transport the medium 17 to the recording portion 20 even when the driving roller 40*a* rotates, may occur. Therefore, in a case where the medium 17 is inserted into the manual feeding path, when the insertion resistance is reduced by moving the movable portion 57, it is possible to prevent the transport error due to the interruption of a manual feeding insertion from occurring.

Meanwhile, in a case where the medium 17 sent by the feeding mechanism 35 is sent back to the driving roller 40*a*, when the movable portion 57 is not disposed in the meeting portion 63, it is not possible to press the deflectively displaced medium 17. Therefore, a feeding accuracy of the medium 17 to the recording portion 20 is reduced because the medium 17 is transported in a skewed state. As a result, there is a concern that a printing accuracy may be deteriorated. Therefore, when the medium 17 is sent by the feeding mechanism 35, the movable portion 57 disposed in the meeting portion 63 does not move, and thus it is possible to maintain the favorable feeding accuracy of the medium 17.

According to Embodiment 1 described above, it is possible to obtain the following effects.

(1) The movable portion 57 disposed in the meeting portion 63 moves, and thus the insertion resistance of the medium 17 is reduced, relative to the manual feeding path. Therefore, the insertion resistance of the medium 17 can be reduced, relative to the manual feeding path of which an extending direction changes in the meeting portion 63 between the manual feeding path and the transport path, without significantly changing the shape of the transport path through which the medium 17 is automatically transported to the recording portion 20.

(2) When the medium 17 is inserted into the manual feeding path, the movable portion 57 moves in a direction in which the area of the meeting portion 63 is expanded. Thus, the insertion resistance of the medium 17 can be reduced, relative to the manual feeding path.

(3) When the medium 17 is inserted into the manual feeding path, the movable member 51 pivots. Thus, the movable portion 57 provided on one end side of the movable member 51 can be moved, in accordance with the pivoting operation, from the inner side of the meeting portion 63 to an external side of the manual feeding path. Therefore, the area of the meeting portion 63 is expanded, and thus the insertion resistance of the medium 17 can be reduced, relative to the manual feeding path. Furthermore, the movable member 51 is pressed by the medium 17 inserted into the manual feeding path, and thus the movable member 51 pivots. Accordingly, without providing a sensor for sensing the insertion of the medium 17 into the manual feeding path or a driving source for pivoting the movable member 51, it is possible to move the movable portion 57 with a simple configuration.

(4) When the driving roller 40*a* causes the medium 17 to be sent back to the feeding mechanism 35 side, the medium 17 is deflectively displaced in the meeting portion 63 and comes into contact with the movable portion 57. In this case, the movement of the movable portion 57 is restricted by the restriction member 52, and thus, even when the deflectively displaced medium 17 presses the movable portion 57, the movable portion 57 does not move. Therefore, the deflection displacement of the medium 17 is regulated, and thus the skew of the medium 17 in the transport path is corrected. On the contrary, in a case where the movable portion 57 is not disposed in the meeting portion 63, the deflection displacement of the medium 17 which is sent back by the feeding mechanism 35 is large. As a result, there is possibility that a skew correction function may be deteriorated. In other words, the restriction member 52 restricts the movement of the movable portion 57, and thus it is possible to prevent the feeding mechanism 35 from reducing a feeding precision of the medium 17.

(5) When the medium 17 is inserted into the manual feeding path, the restriction member 52 releases the movement restriction of the movable portion 57. Thus, when the medium 17 is inserted into the manual feeding path, it is possible to reduce the insertion resistance of the medium 17, in such a manner that the movable portion 57 is moved.

(6) When the medium 17 inserted into the manual feeding path abuts on the engaging protrusion portion 55, the movement restriction of the movable portion 57 is released. Thus, without providing, for example, a sensor for sensing the insertion of the medium 17 into the manual feeding path, it is possible to distinguish an insertion path of the medium 17 with a simple configuration and it is possible to control a movement of the movable portion 57.

(7) When the medium 17 is sent by the feeding mechanism 35, the medium 17 sent by the feeding mechanism 35 can be guided by the movable portion 57 which protrudes further on the inner side of the meeting portion 63 than the second path forming portion 62. Meanwhile, when the medium 17 is inserted into the manual feeding path, the movable portion 57 moves further on the external side of the meeting portion 63 than the second path forming portion 62. Therefore, the medium 17 which is guided, by the first path forming portion 61, to the meeting portion 63 is guided by the second path forming portion 62 and passes through the meeting portion 63. In this case, the intersection angle between the second path forming portion 62 and the transport path is smaller than the intersection angle between the first path forming portion 61 and the transport path, and thus a change in the movement direction of the medium 17 is gentle in the meeting portion 63. Thus, it is possible to prevent the medium 17 from being caught by the second path forming portion 62 of the medium 17. In other words, since the intersection angle between the manual feeding path and the transport path is reduced by moving the movable portion 57 outside the meeting portion 63, the insertion resistance of the medium 17 can be reduced, relative to the manual feeding path.

Embodiment 2

Next, Embodiment 2 of the recording apparatus will be described with reference to FIG. 9.

The recording apparatus of Embodiment 2 is different from the recording apparatus of Embodiment 1, in that a rotary roller 70 which is rotatably supported in the manual feed path forming member 34 is provided as a movable portion, instead of the movable mechanism of Embodiment 1. Other configurations are substantially the same as those of Embodiment 1. Members in Embodiment 2, to which the same reference numerals as those in the Embodiment 1 are given, have the same configuration as in Embodiment 1, and thus the description of the members is not repeated. Hereinafter, the following description will place focus on differences between Embodiment 1 and Embodiment 2.

Figure 9:
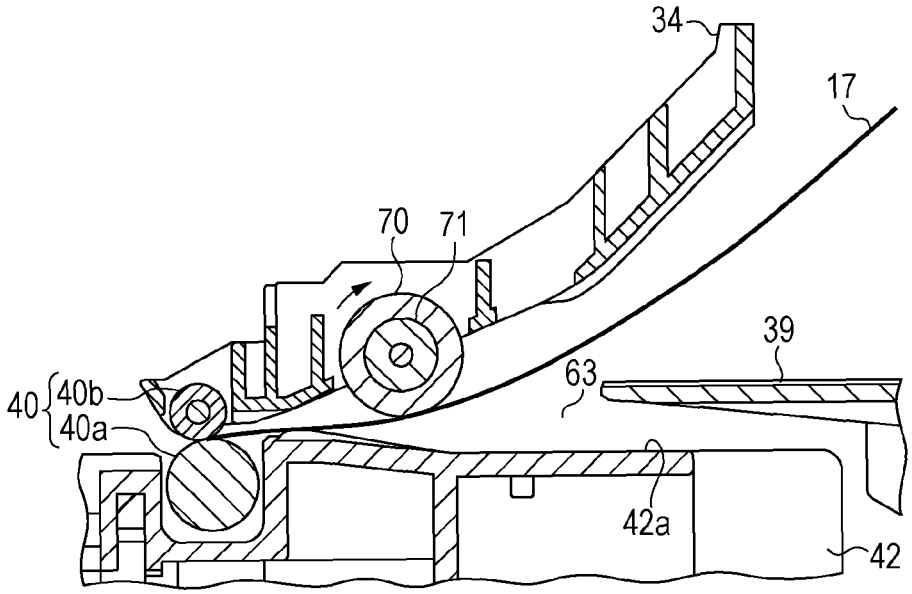
FIG. 9 is a cross-sectional view of a guide portion of Embodiment 2.

A part of the rotary roller 70, which is a part of a peripheral portion of the rotary roller 70, protrudes to the meeting portion 63, as illustrated in FIG. 9. The rotary roller 70 is arranged in a position apart from the support member 42 such that the peripheral portion protruding to the meeting portion 63 forms the transport path, in a portion between the rotary roller 70 and the support member 42.

The rotary roller 70 has a one-way clutch 71. The one-way clutch 71 is an example of a restriction member which allows the rotary roller 70 to rotate in one direction (the clockwise direction in FIG. 9) illustrated by the arrow in FIG. 9 and prevents the rotary roller 70 from rotating in a direction (a counter-clockwise direction in FIG. 9) opposite to the one direction.

Next, an operation of the recording apparatus of Embodiment 2 will be described.

When the medium 17 sent by the feeding mechanism 35 (see FIG. 2) is sent back by the driving roller 40*a*, the medium 17 in a deflectively-displaced state presses the rotary roller 70. Thus, there is a concern that a rotating force which causes the rotary roller 70 to rotate in a reverse direction (the counter-clockwise direction in FIG. 9) may be applied to the rotary roller 70.

In this case, the one-way clutch 71 prevents the rotary roller 70 from rotating in the reverse direction. Thus, the rotary roller 70 does not rotate in the reverse direction. Accordingly, the medium which tends to be deflectively displaced is pushed back to the peripheral surface of the rotary roller 70, and thus a deflection displacement of the medium 17 is prevented. As a result, the skew of the medium 17 in the transport path is corrected.

Meanwhile, when the medium 17 inserted into the manual feeding path enters the meeting portion 63 and comes into contact with the rotary roller 70, the rotary roller 70 rotates in the one direction (the clockwise direction in FIG. 9), in accordance with the movement of the medium 17. As a result, the insertion resistance of the medium 17 is reduced, relative to the manual feeding path.

According to Embodiment 2 described above, it is possible to obtain the following effect, in addition to the effect (1) described above.

(8) When the medium 17 inserted into the manual feeding path by manual feeding enters the meeting portion 63, the rotary roller 70 rotates in accordance with the movement of the medium 17, of which the movement direction changes in the meeting portion 63. Thus, it is possible to reduce the insertion resistance of the medium 17.

Embodiment 3

Next, Embodiment 3 of the recording apparatus will be described with reference to FIGS. 10 and 11.

The recording apparatus of Embodiment 3 is different from the recording apparatus of Embodiment 1, in that the configuration of the movable mechanism is modified. Other configurations are substantially the same as those of Embodiment 1. Members in Embodiment 3, to which the same reference numerals as those in the Embodiment 1 are given, have the same configuration as in Embodiment 1, and thus the description of the members is not repeated. Hereinafter, the following description will place focus on differences between Embodiment 1 and Embodiment 3.

Figure 10:
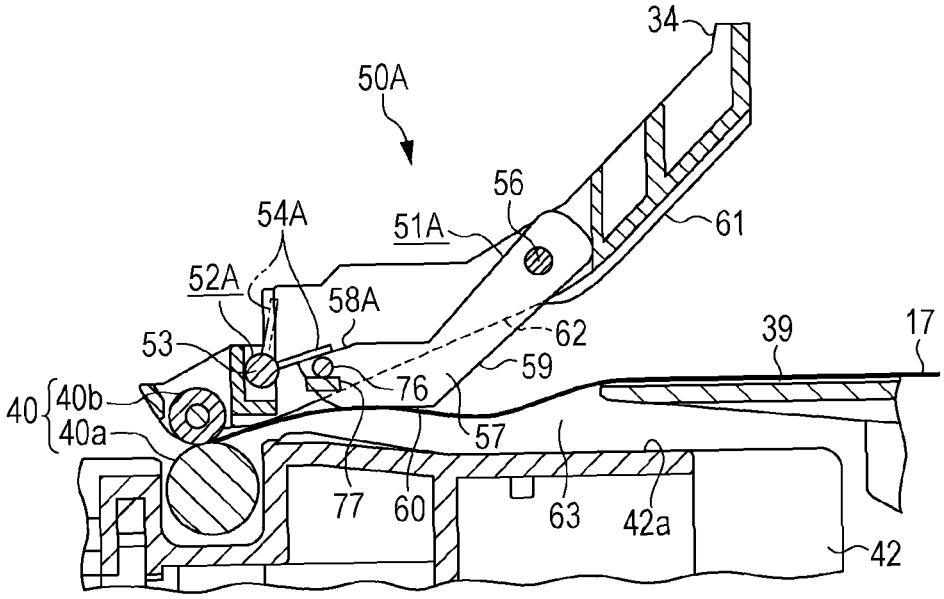
FIG. 10 is a cross-sectional view illustrating a state where a guide portion of Embodiment 3 is arranged in a meeting portion.

A movable member 51A of Embodiment 3 has a pivot shaft portion 56 which is provided on a base end side (a right end side in FIG. 10), an engaging wall portion 58A which is provided on an upper surface of a tip side (the left side in FIG. 10), a support shaft portion 76 which extends, in the width direction, from the tip side, and the movable portion 57 which is provided in a portion between the pivot shaft portion 56 and the engaging wall portion 58A, as illustrated in FIG. 10.

A locking portion 77 which can lock the support shaft portion 76 is provided on the manual feed path forming member 34. When an external force is not applied to the movable member 51A, the support shaft portion 76 is locked by the locking portion 77, and thus the movable member 51A is located in a non-operating position illustrated in FIG. 10. In addition, when the movable member 51A is located in the non-operating position, the movable portion 57 is disposed in the meeting portion 63.

The restriction member 52A includes the pivot shaft portion 53 to which rotation of the driving roller 40*a* is transmitted via a gear train (not illustrated) and a restriction portion 54A which extends from the pivot shaft portion 53. When the driving roller 40*a* rotates, the restriction member 52A rotates in the same direction as the driving roller 40*a*.

When the restriction member 52A rotates in the counter-clockwise direction in FIG. 10, the restriction portion 54A is disposed in a standby position (in a position illustrated by a two-dot chain line in FIG. 10) apart from the movable member 51A. Meanwhile, when the restriction member 52A rotates in the clockwise direction in FIG. 10, the restriction portion 54A moves to a restriction position in which the restriction portion 54A is engaged with the engaging wall portion 58A of the movable member 51A and restricts a pivoting operation (the pivoting operation in the clockwise direction in FIG. 10) of the movable member 51A, as illustrated by a solid line in FIG. 10.

Next, an operation of the recording apparatus of Embodiment 3 will be described.

When the driving roller 40*a* rotates, in the normal rotation direction (the counter-clockwise direction in FIG. 10), to transport the medium 17, the restriction member 52A pivots in the counter-clockwise direction in FIG. 10 and is disposed in the standby position. Therefore, during a period, from when the preceding recording operation is finished, until the subsequent recording operation is performed on the medium 17, the restriction member 52A is disposed in the standby position.

When the leading edge of the medium 17 which is sent to the transport path by the feeding mechanism 35 (see FIG. 2) passes through the meeting portion 63, the driving roller 40*a* rotates in the reverse rotation direction, that is the clockwise direction in FIG. 10. As a result, the medium 17 is sent back.

When the driving roller 40*a* rotates in the reverse rotation direction, the restriction member 52A rotates in the clockwise direction in FIG. 10, and thus the restriction portion 54A moves from the standby position to the restriction position and abuts on the engaging wall portion 58A of the movable member 51A. Accordingly, pivoting of the movable member 51A in the clockwise direction in FIG. 10 is restricted, and thus the movement of the movable portion 57 is restricted. Thus, even when the medium 17 sent back to the meeting portion 63 presses the second pressure receiving portion 60, the movable portion 57 does not move, and thus the deflection displacement of the medium 17 is restricted. As a result, the skew of the medium 17 is corrected.

When, after the skew of the medium 17 is corrected, the driving roller 40*a* rotates in the normal rotation direction, the medium 17 is pinched by the transport roller pair 40 and transported to the recording portion 20. Furthermore, the restriction member 52A rotates in the counter-clockwise direction in FIG. 10, in accordance with the rotation of the driving roller 40*a* in the normal rotation direction. Accordingly, the restriction member 52A returns from the restriction position to the standby position, and thus the restriction of the pivoting operation of the movable member 51A is released.

Meanwhile, when, after the preceding recording operation is finished, the medium 17 is inserted into the manual feeding path, the medium 17 entering the meeting portion 63 presses the first pressure receiving portion 59 of the movable portion 57. As a result, the movable member 51A pivots in the clockwise direction in FIG. 10.

Figure 11:
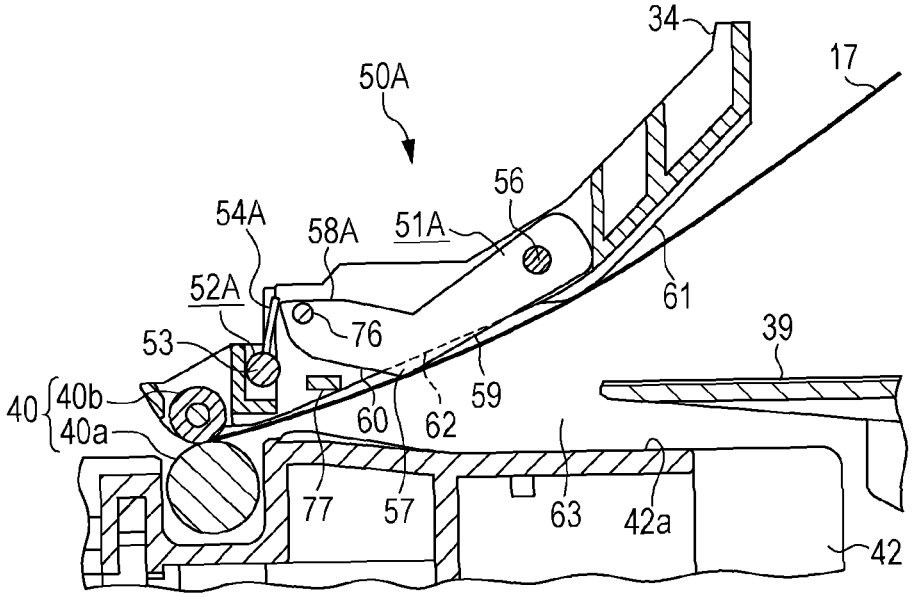
FIG. 11 is a cross-sectional view illustrating a state where the guide portion of Embodiment 3 is moved outside the meeting portion.

As a result, the movable portion 57 disposed in the meeting portion 63 moves back to the external side of the meeting portion 63, in accordance with the pivoting operation of the movable member 51A, as illustrated in FIG. 11. Therefore, the area of the meeting portion 63 is expanded, and thus the insertion resistance of the medium 17 is reduced, relative to the manual feeding path.

According to Embodiment 3 described above, it is possible to obtain the following effect, in addition to the effects (1) to (4), and (7) described above.

(9) When the driving roller 40*a*, which sends back the medium 17, rotates in the reverse rotation direction, the restriction member 52A restricts the movement of the movable portion 57. On the contrary, when the driving roller 40*a* rotates in the normal rotation direction, the restriction member 52A releases the restriction of the movement of the movable portion 57. Therefore, without providing, for example, a sensor for sensing the insertion of the medium 17 into the manual feeding path, it is possible to control the operation of the movable portion 57, with a simple configuration.

Embodiment 4

Next, Embodiment 4 of the recording apparatus will be described with reference to FIGS. 12 and 13.

The recording apparatus of Embodiment 4 is different from the recording apparatus of Embodiment 1, in that the recording apparatus of Embodiment 4 does not have a restriction member but has a movable member 51B which is pivotally supported in the manual feed path forming member 34. Other configurations are substantially the same as those of Embodiment 1. Members in Embodiment 4, to which the same reference numerals as those in the Embodiment 1 are given, have the same configuration as in Embodiment 1, and thus the description of the members is not repeated. Hereinafter, the following description will place focus on a difference between Embodiment 1 and Embodiment 4.

Figure 12:
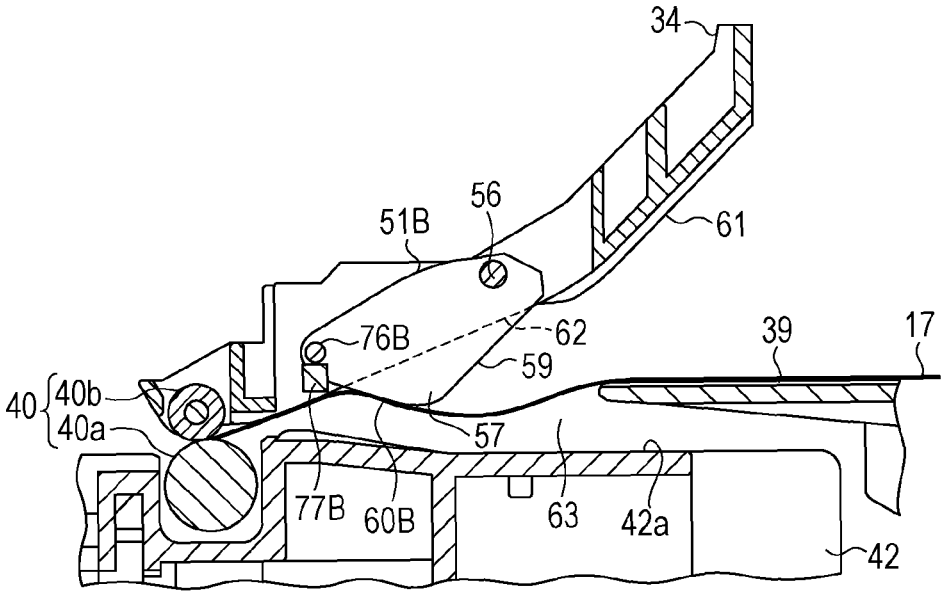
FIG. 12 is a cross-sectional view illustrating a state where a guide portion of Embodiment 4 is arranged in the meeting portion.

The movable member 51B has the pivot shaft portion 56 which is provided on the base end side (the right end side in FIG. 12), a support shaft portion 76B which is provided on the tip side (the left end side in FIG. 12), and the movable portion 57 which is provided in a portion between the pivot shaft portion 56 and the support shaft portion 76, as illustrated in FIG. 12.

A locking portion 77B which can lock the support shaft portion 76B is provided in the manual feed path forming member 34. When an external force is not applied to the movable member 51B, the support shaft portion 76B of the movable member 51B is locked by the locking portion 77B, and thus the movable member 51B is disposed in the non-operating position illustrated in FIG. 12. Furthermore, when the movable member 51B is located in the non-operating position, the movable portion 57 is disposed in the meeting portion 63.

The movable portion 57 has a first pressure receiving portion 59 and a second pressure receiving portion 60B. When the movable portion 57 is disposed in the meeting portion 63, the extending direction of the first pressure receiving portion 59 is substantially parallel to the extending direction of the first path forming portion 61 and the extending direction of the second pressure receiving portion 60B extends in a direction intersecting with the extending direction of the second path forming portion 62 and the extending direction of the transport path. The pivot shaft portion 56 is disposed on a front side in a pressing direction at the time that the medium 17 which is deflectively displaced by being sent back to the driving roller 40*a* presses the second pressure receiving portion 60B.

Next, an operation of the recording apparatus of Embodiment 4 will be described.

When the leading edge of the medium 17 which is sent to the transport path by the feeding mechanism 35 (see FIG. 2) passes through the meeting portion 63, the driving roller 40*a* rotates in the reverse rotation direction, that is, the clockwise direction in FIG. 12. Therefore, the medium 17 is sent back.

In this case, although the medium 17 which is sent back to the meeting portion 63 is deflectively displaced and presses the second pressure receiving portion 60B, the movable member 51B does not pivot because the pivot shaft portion 56 of the movable member 51B is located on the front side in the pressing direction of the medium 17. In other words, the movable portion 57 does not move in a state where the movable portion 57 is disposed in the meeting portion 63, and thus the medium 17 is pressed back by the movable portion 57. As a result, the deflection displacement of the medium 17 is regulated, and thus the skew of the medium 17 is corrected.

Meanwhile, when the medium 17 is inserted into the manual feeding path, the medium 17 entering the meeting portion 63 presses the first pressure receiving portion 59 of the movable portion 57, and thus the movable member 51B pivots in the clockwise direction in FIG. 12.

Figure 13:
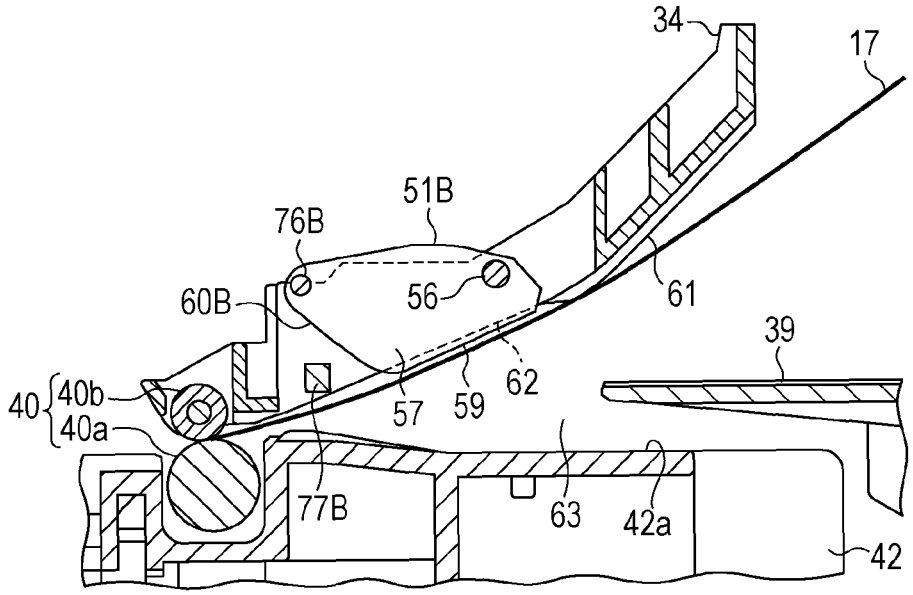
FIG. 13 is a cross-sectional view illustrating a state where the guide portion of Embodiment 4 is moved outside the meeting portion.

As a result, the movable portion 57 disposed in the meeting portion 63 moves back to the external side of the meeting portion 63, in accordance with the pivoting operation of the movable member 51B, as illustrated in FIG. 13. Therefore, the area of the meeting portion 63 is expanded, and thus the insertion resistance of the medium 17 is reduced, relative to the manual feeding path.

According to Embodiment 4 described above, it is possible to obtain the following effects, in addition to the effects (1) to (3), and (7).

(10) When the medium 17 is sent back by the driving roller 40*a*, the medium 17 is deflectively displaced in the meeting portion 63 and comes into contact with the movable portion 57. In this case, since the pivot shaft portion 56 of the movable member 51B is positioned on the front side in the pressing direction of the medium 17, the movable member 51B does not pivot. In other words, the movable portion 57 does not move, and thus, even when the medium 17 in a deflectively displaced state presses the movable portion 57, the movable member 51B does not pivot. Therefore, the deflection displacement of the medium 17 is restricted, and thus the skew of the medium 17 in the transport path is corrected. As a result, it is possible to prevent the feeding accuracy of the medium 17 from being deteriorated.

(11) It is possible to restrict the movement of the movable portion 57 pressed by the medium 17, without providing a member for restricting the pivoting operation of the movable member 51B, and thus it is possible to prevent, with a simple configuration, the feeding accuracy of the medium 17 from being deteriorated.

The embodiments described above may be modified as follows.

The recording apparatus may be configured as follows. A movable portion which moves in accordance with the rotational operation of the driving roller 40*a* is provided. Therefore, when the driving roller 40*a* rotates in the reverse rotation direction, the movable portion is disposed in the meeting portion 63. On the contrary, when the driving roller 40*a* rotates in the normal rotation direction, the movable portion moves back from the meeting portion 63. In other words, when the medium is inserted into the manual feeding path, the movable portion does not move in a state where the movable portion is disposed on the external side of the meeting portion 63. On the contrary, when the medium 17 is sent back by the driving roller 40*a*, the movable portion moves to an inner side of the meeting portion 63. According to this configuration, without providing, for example, a sensor for sensing the insertion of the medium 17 into the manual feeding path, it is possible to control the operation of the movable portion with a simple configuration.

The recording apparatus may be configured as follows. When the manual feed guide 31 is located in a closed position in which the manual feed guide 31 covers the insertion opening 32, the movable portion is disposed in the meeting portion 63. On the contrary, when the manual feed guide 31 pivots from the closed position, and thus the medium 17 can be inserted into the manual feeding path, the movable portion moves back from the meeting portion 63. According to this configuration, without providing, for example, a sensor for sensing the insertion of the medium 17 into the manual feeding path, it is possible to restrict the movement of the movable portion with a simple configuration. In addition, it is possible to move the movable portion even when the medium 17 does not press the movable portion. Thus, it is possible to further reduce the insertion resistance of the medium 17, relative to the manual feeding path.

Figure 14:
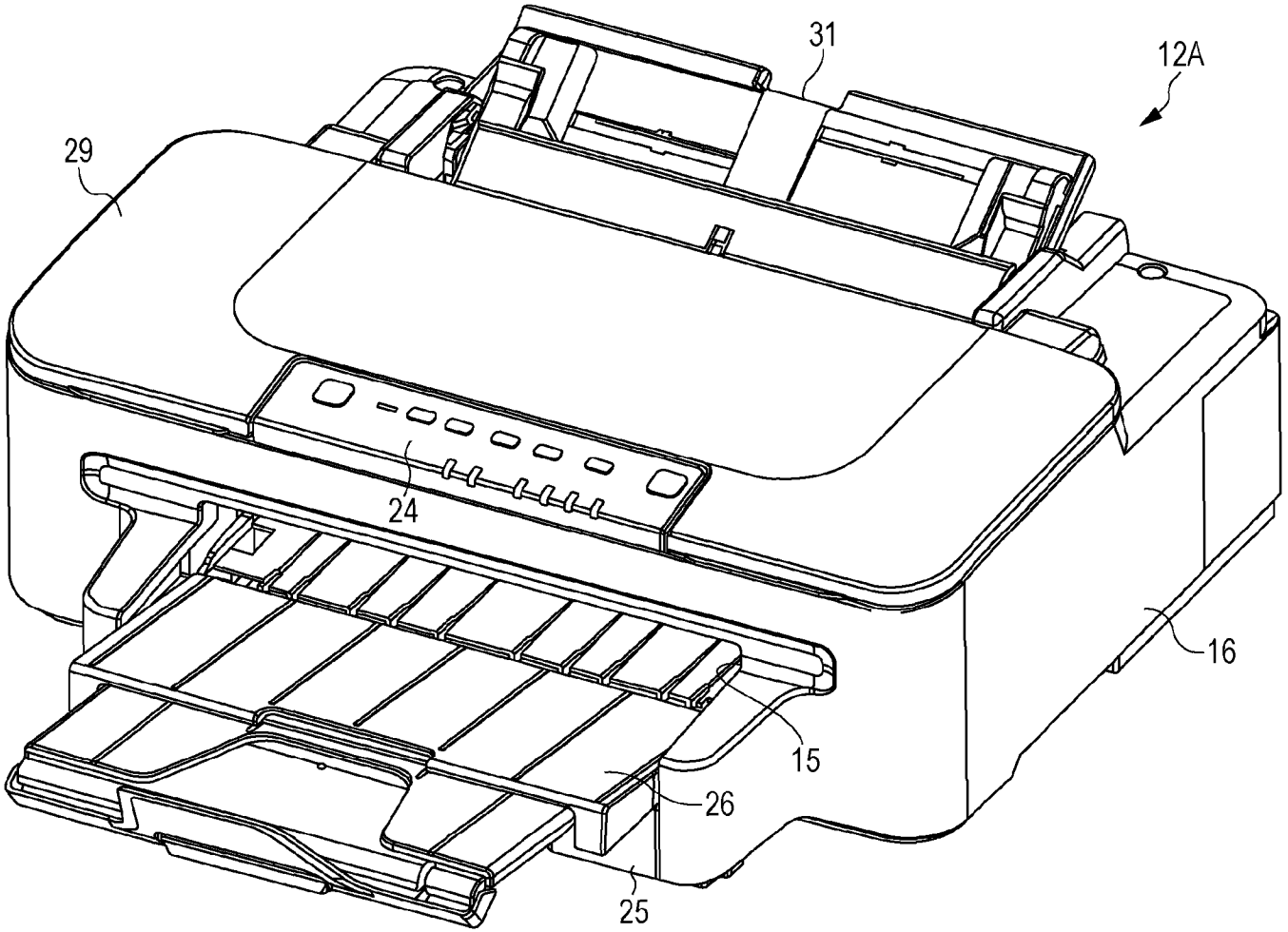
FIG. 14 is a perspective view illustrating a recording apparatus of a modification example.

The recording apparatus may be a recording apparatus 12A in which a cover portion 29 is openably/closably installed in the casing portion 16, as illustrated in a modification example of FIG. 14. In other words, the recording apparatus is not limited to a recording apparatus which is provided in a multifunction printer having an image reading function and may be a printer having only the printing function. Alternatively, the recording apparatus may be a recording apparatus which is provided in a facsimile machine, a copying machine, or a multifunction printer including these machines.

The recording apparatus may be a so-called full-line type recording apparatus in which the recording portion 20 does not includes the carriage 21 and which has a long and fixed recording head corresponding to the entire width of the medium 17. The recording head in this case may have a configuration in which a plurality of unit head portions having nozzles formed thereon are arranged in parallel, and thus a recording range covers the entire width of the medium 17. Alternatively, the recording head may have a configuration in which a plurality of nozzles are arranged on a single long head so as to cover the entire width of the medium 17, and thus the recording range covers the entire width of the medium 17.

The receiving portion 23 in which a recording material supplied to the recording head 22 is received is not limited to a cartridge which is attachably/detachably mounted on the carriage 21 and may be a tank which is fixed, in the casing portion 16, at a predetermined position other than the carriage 21.

The receiving portion 23 may have a configuration so that a pack having flexibility, in which a recording material is received, is accommodated in a case having hardness or may have a configuration so that a recording material is directly received in the case having hardness.

A pouring port through which a recording material may be poured is provided in the receiving portion 23, and thus the recording material may be poured or replenished through the pouring port. According to this configuration, it is possible to replenish the recording material, without attaching or detaching the receiving portion 23.

The recording apparatus may have a configuration so that the receiving portion 23 is disposed outside the casing portion 16 and a recording material received in the receiving portion 23 is supplied to the recording head 22 through, for example, a supply tube connected to the carriage 21. In this case, the receiving portion 23 may be fixed to an external surface of the casing portion 16 or the receiving portion 23 may be disposed in a position apart from the casing portion 16. According to this configuration, the size of the receiving portion 23 is not limited by the volume of the casing portion 16, and thus the receiving portion 23 can be increased in size. Therefore, it is possible to continuously perform more recording.

In a case where a recording material is supplied from an external side of the casing portion 16 to the recording head 22 via a supply tube, a hole or a notch through which the supply tube passes may be provided in the casing portion 16. According to this configuration, even when the supply tube through which the recording material is supplied from the external side of the casing portion 16 to the recording head 22 is constituted by a material having low hardness, the collapse of the supply tube is prevented. Thus, it is possible to ensure a flow path from the receiving portion 23 which is disposed outside the casing portion 16 to the recording head.

Alternatively, the recording apparatus may be configured as follows. A boss or the like is erected to prevent an opening/closing body, such as the image reading device 14 and the cover portion 29, which is openably/closably provided on the casing portion 16 from being completely closed, and a supply tube passes through a gap which is formed, by the boss, between the casing portion 16 and the opening/closing body. According to this configuration, it is possible to prevent the collapse of the supply tube, without providing a hole or a notch in the casing portion 16.

A recording material used for recording may be fluid (including liquid, a liquid body which is formed by dispersing, or mixing functional material particles in liquid, a fluid body, such as gel, and solids which can flow and be ejected as fluid) other than ink. The recording apparatus may have a configuration so that recording is performed by ejecting a liquid body which contains, in a dispersed or dissolved manner, an electrode material used for manufacturing a liquid crystal display, an electroluminescence (EL) display or a surface emitting display or contains material, such as a coloring material (a pixel material).

The recording apparatus may be a fluid-body ejecting apparatus which ejects a fluid body, such as gel (for example, physical gel) or a particle-body ejecting apparatus (for example, a toner jet type recording apparatus) which ejects solids, such as powder (granules), for example, toner. The concept of the term "fluid" in this specification does not include a liquid composed of only gas. The fluid includes, for example, liquid (including inorganic solvent, organic solvent, solutions, liquid resins, liquid metal (molten metal), and the like), a liquid body, a fluid body, powder (including granules and pulverulent bodies), and the like.

The recording apparatus is not limited to a printer in which printing is performed by ejecting fluid, such as ink, but may be, for example, a non-impact printer, such as a laser printer, an LED printer, a thermal-transfer printer (including a sublimation printer), or an impact printer, such as a dot impact printer.

The entire disclosure of Japanese Patent Application No. 2013-144266, filed Jul. 10, 2013 is expressly incorporated by reference herein.

What is claimed is:

1. A recording apparatus comprising:

a recording portion which performs recording on a medium;

a transport path which transports a first medium which is fed from a medium accommodating unit to the recording portion;

a manual feeding path which transports a second medium which is inserted into an opening portion for manual feeding to the recording portion;

a movable mechanism which is disposed in a meeting portion between the transport path; and a transport roller pair which is disposed between the recording portion and the meeting portion and which transports the first medium and the second medium to the recording portion, wherein, while skew correction is performed on the first medium by the transport roller pair, the movable mechanism does not move when the first medium contacts with the movable mechanism, and while the second medium is inserted into the manual feeding path, the movable mechanism is pivoted by being pressed by the second medium and moves to an external side of the manual feeding path.

2. The recording apparatus according to claim 1, further comprising:

a restriction member which restricts movement of the movable mechanism while skew correction is performed on the first medium by the transport roller pair, wherein deflection displacement of the first medium is regulated by the movable mechanism of which the movement is restricted by the restriction member.

3. The recording apparatus according to claim 2, wherein, when the second medium is inserted into the manual feeding path, the restriction member releases movement restriction of the movable mechanism.

4. The recording apparatus according to claim 2, wherein the restriction member has an engaging protrusion portion which can protrude to the manual feeding path and, when the second medium inserted into the manual feeding path abuts on the engaging protrusion portion, the restriction member releases the movement restriction of the movable mechanism.

* * * * *